US007454815B2

(12) United States Patent
Brinkmann

(10) Patent No.: US 7,454,815 B2
(45) Date of Patent: Nov. 25, 2008

(54) COUPLING DEVICE

(75) Inventor: Michael Brinkmann, Halle/Westfalen (DE)

(73) Assignee: Hörmann KG Brockhagen, Steinhagen (DE)

( * ) Notice: Subject to any disclaimer, the term of this patent is extended or adjusted under 35 U.S.C. 154(b) by 810 days.

(21) Appl. No.: 10/511,520

(22) PCT Filed: Apr. 15, 2002

(86) PCT No.: PCT/EP02/04158

§ 371 (c)(1),
(2), (4) Date: Oct. 15, 2004

(87) PCT Pub. No.: WO03/087508

PCT Pub. Date: Oct. 23, 2003

(65) Prior Publication Data

US 2005/0102956 A1 May 19, 2005

(51) Int. Cl.
*E05D 7/12* (2006.01)

(52) U.S. Cl. ..... 16/271

(58) Field of Classification Search ..... 16/91, 16/97, 102, 105–107, 236, 237, 240, 243, 16/271; 49/425; 160/201, 229.1, 235–236
See application file for complete search history.

(56) References Cited

U.S. PATENT DOCUMENTS 546,909 A * 9/1895 Spencer ..... 16/270
1,469,525 A * 10/1923 Nadolney ..... 16/271
1,481,142 A * 1/1924 Minton et al. ..... 16/271
2,196,903 A * 4/1940 Rowe et al. ..... 160/201
2,239,273 A 4/1941 Norberg et al.
2,525,309 A * 10/1950 Norberg ..... 16/97
2,703,141 A * 3/1955 Mckee ..... 160/209
3,060,491 A * 10/1962 Pemberton et al. ..... 16/97
3,140,508 A 7/1964 Switzgable
3,376,913 A 4/1968 Clapsaddle
4,115,900 A * 9/1978 Mihalcheon ..... 16/104
5,002,114 A * 3/1991 Hormann ..... 160/229.1
5,992,497 A * 11/1999 Jaehnen et al. ..... 160/201
6,098,697 A * 8/2000 Krupke et al. ..... 160/229.1
6,315,027 B1 * 11/2001 Lichy ..... 160/205

FOREIGN PATENT DOCUMENTS

EP 0304642 3/1989
EP 0370376 5/1990

* cited by examiner

*Primary Examiner*—Chuck Y. Mah
(74) *Attorney, Agent, or Firm*—Friedrich Kueffner

(57) ABSTRACT

The invention relates to a coupling device for creating a hinged connection between adjacent panels of a sectional door leaf, comprising a connecting element that is fixed to the adjacent panels and a support element holding a guiding element which interacts with a guide rail. Said support element is fixed, preferably in a detachable manner, to the connecting element once said connecting element has been fastened to the panels.

10 Claims, 2 Drawing Sheets

COUPLING DEVICE

BACKGROUND OF THE INVENTION

The invention pertains to a connecting device for producing articulated connections between successive panels of a sectional door leaf.

Sectional doors are used as garage doors or industrial gates and are characterized in that, when the door is opened and closed, the sectional door leaf does not pivot outward into the area located in front of the space to be closed by the door. This is achieved in that the door leaf of a sectional door, which can be moved along a path determined by a guide rail arrangement between a closed position, in which it is in an essentially vertical plane, and an open position, in which it is usually in an overhead horizontal plane, consists of a plurality of panels, arranged in a row extending along the predetermined path, these panels being connected to each other by joints with axes which are perpendicular to the predetermined path. These connecting elements which produce the articulated connections between the successive panels are usually designed as hinges, which are attached to the inside surface of the panels of the sectional door leaf, i.e., to the surface facing the interior space of the room to be closed by the sectional door leaf. The hinge flaps are attached by screws to adjacent panels. The rolled parts of the hinge, which make it possible to connect the two flaps pivotably to each other, can be seated at least partially in a recess formed between the adjacent panels, so that they project toward the outer surface of the door leaf. Installing the rolled parts of the hinges in this way makes it easier to avoid the formation of gaps between successive panels when the panels are traveling around the circular arc-shaped section of the predetermined path and thus also offers protection against pinched fingers. In the case of the known sectional door leaves, this type of protection for the fingers is brought about in that a projection formed along the edge of one panel is accepted in a recess formed in the edge of an adjacent panel, i.e., the edge facing the projecting edge of the first panel. These types of sectional door leaves are described in, for example, EP 304 642 A1 and EP 370 376 A1. With respect to the design of the individual panels of a sectional door leaf and to the design of the guide rail arrangement of corresponding sectional doors, the disclosure content of these documents is herewith included in the present specification by explicit reference.

So that the door leaf can be guided between the closed position and the open position, guide elements, usually in the form of rollers, are attached to the successive panels of the sectional door leaf; these rollers cooperate with guide rails, which are installed permanently in the space to be closed, near the lateral edges of the door leaf. These guide elements are usually attached to the connecting elements, which are fastened to the lateral edges of the panels, where the longitudinal axis of the guide element, i.e., the axle of the roller, is more-or-less parallel to the joint axis of the connecting element. To prevent the connecting elements from being overextended and thus the panels from being damaged during the movement of the door leaf between the open position and the closed position, the longitudinal axis of the guide element, i.e., the axle of the roller, is usually located as close as possible to the joint axis of the connecting element. To avoid an unnecessarily large number of components, the carrier element of conventional connecting devices of the type described above, i.e., the element which serves to hold the guide element on the door leaf, is formed by one of the hinge flaps of the connecting element. To this end, the hinge flap is designed with a U-shaped profile, the outer sidepiece of which has a hole, which serves to accept a retaining bolt or the axle of the guide element roller.

As already explained above, it is usually necessary for the longitudinal axis of the guide element, i.e., the axle of the roller, to be near the joint axis of the connecting element. The connecting element, furthermore, is usually attached to the panel in the immediate vicinity of the joint axis. This has the result of minimizing the mechanical loads exerted on the connection between the connecting element and the panel, whereas it is possible at the same time to use the edge of the panel, which is usually reinforced, to achieve a secure attachment of the connecting element. The panel can be reinforced in the area of the edge adjacent to the joint axis by, for example, bending the edge of a sheet-metal panel back upon itself.

When sectional doors are installed with the use of these known connecting devices, the problem arises that, because of the proximity of the guide element to the joint axis, the guide element mounted on the connecting element interferes with access to the fastening elements used to attach the connecting element to the panel, inasmuch as these fastening elements are also in the vicinity of the joint axis. For this reason, the following sequence of steps is usually used to install a conventional sectional door: The first step is to install the guide rails required to guide the movement of the sectional door leaf in the room to be closed by the sectional door. The second step is to attach the connecting elements, designed as hinges, to the upper edge of the panel which is at the bottom when the door is closed. Third, the guide element is attached to the hinge flap which has just been attached to the panel; this flap is designed with a U-shaped profile which serves simultaneously as the carrier for the guide element. Next, the guide elements attached via the carrier element to the panel are threaded into the guide rail arrangement, and the panel together with its guide elements is brought into the position it will occupy when the door is closed. The following panel is prepared in the same way by attaching the connecting elements and the guide elements to the upper edge, and, after the guide elements have been threaded into the guide rail arrangement, the panel is mounted on the previously threaded-in panel in the position it will occupy when the door is closed. The free hinge flaps of the connecting elements attached to the first threaded-in panel can then be attached to the lower edge of the panel which was threaded in next. In this way, the successive panels can be threaded in, one after the other, into the guide rail arrangement and hinged together until the complete door leaf has been assembled.

This installation process is usually very time-consuming, however, and therefore also expensive, because the guide rail arrangement must first be installed without the support of the door leaf, which could have served as an installation aid. As a result, the mounting of the guide rail arrangement requires complicated measuring work, which must be performed with such accuracy that the individual panels of the door leaf will be guided smoothly by the guide rail arrangement both during the installation process and afterwards in normal operation.

Connecting devices for producing articulated connections between successive panels of a sectional door leaf are described in U.S. Pat. No. 223,927 A and in U.S. Pat. No. 3,376,913 A.

SUMMARY OF THE INVENTION

In view of these problems of the state of the art, the invention is based on the task of providing a connecting device of the type described above which makes it possible to install sectional doors easily without any significant increase in the number of components and of providing a corresponding sectional door leaf and an installation process which can be implemented with the use of the inventive connecting device.

This connecting device makes it possible to install sectional doors by a process in which, first, the successive panels of the door leaf are arranged in the wall opening to be closed by the door in a position corresponding to the closed position of the door, so that these panels can be hinged to each other without interference from the guide elements. Second, the guide rails are attached with the help of the door leaf, which is already located in the opening and thus can serve as an installation aid. Finally, the carrier elements, in which the guide elements have already been mounted, are attached to the connecting elements, which have been attached previously to the panels. The carrier elements can be attached without an excessive number of components and yet still offer sufficient strength; because the connecting elements, which have already been attached to the panels, i.e., the fastening elements used to attach them, are available to add additional strength to the attachment of the carrier element. Overall, therefore, in spite of the two-part design of the inventive connecting device, the installation of sectional doors can be greatly simplified without a significant increase in the number of parts, because the connecting device designed according to the invention makes it possible to use the door leaf as an installation aid for the attachment of the guide rail arrangement, this being done in such a way that the guide elements mounted in the connecting device cannot interfere with the attachment of the connecting elements of the inventive connecting device to the panels. These connecting elements, furthermore, can be attached at any desired location, which means that adequate mechanical stability can be ensured, and protection against pinched fingers, which may also be desired, can also be provided.

Because the connecting element has at least one contact surface which can be laid against one of the panels and a fastening surface which is a certain distance away from this contact surface in a direction perpendicular to it, it is possible to attach the carrier element of the inventive connecting device to the connecting element without any additional fastening elements by the use of a simple clamping method. Thus, after the contact surface has been attached to the panel, the fastening area of the carrier element can be inserted into the intermediate space formed between the panel and the fastening surface. The carrier element can be attached to the connecting element in this case by means of the screws which are used to fasten the connecting element, designed as a hinge, for example, to the panel. These screws have the effect of clamping the fastening area of the carrier element between the contact surface and the inner surface of the panel.

It has been found to be especially favorable for a first opening to be provided in the fastening surface and for a second opening to be provided in the fastening area. When the fastening area is inserted into the intermediate space formed between the fastening surface and the panel, these two openings can be brought into alignment with each other. As a result, an additional stabilization of the attachment of the carrier element to the connecting element can be achieved with the help of a fastening element, designed preferably as a screw, which can be passed through the two openings and, if desired, introduced into the panel as well.

As already explained above, the connecting element, possibly designed as a hinge, is advisably attached to the panel by means of screws. For this purpose, preferably at least one third opening is provided in the contact surface to accept a fastening screw.

The connecting element of an inventive connecting device comprises in general two parts, which can pivot with respect to each other around a joint axis, and each of which can be attached to one of the successive panels. So that the mechanical stability can be increased and advantage can be taken of the reinforcements in the area of the facing edges of the successive panels, it is generally preferred, as already explained above, for the connecting element to be attached at a point near the joint axis. Therefore, the minimum of one third opening in the connecting element of an inventive connecting device is preferably located between the first opening and the joint axis. As a result of this offset between the minimum of one third opening and the first opening in the connecting element in a direction perpendicular to the joint axis, furthermore, it also becomes possible to attach the carrier element to the connecting element with the help of a screw passing through the first and second openings without interference from the guide element, which will usually be located near the joint axis. As also in the case of a conventional connecting device in which the hinge flap is designed as a carrier element, the carrier element of the inventive connecting device should also have at least one fourth opening, which is designed to accept a retaining bolt extending parallel to the joint axis, i.e., the corresponding axle of the roller serving as guide element. The two-part design of the inventive connecting device makes it possible to locate this fourth opening with respect to the third opening in such a way that a plane which is perpendicular to the contact surface and parallel to the joint axis and passes through the minimum of one third opening also passes through the minimum of one fourth opening. As a result, the retaining bolt held in the minimum of one fourth opening will not interfere with the attachment of the connecting element to the panel, because the carrier element holding the guide element does not have to be attached to the connecting element until after the connecting element has been attached to the panel.

The retaining bolt of the guide element can be held very reliably in the carrier element because the carrier element is designed as an essentially U-shaped profile in a cross-sectional plane parallel to the joint axis and perpendicular to the contact surface, where each of the two outer sidepieces of this profile has a fourth opening, and where the connecting sidepiece has a second opening. So that protection for the fingers can be obtained in the area of the inventive connecting device, it has been found advisable for a distance of more than 8 mm, preferably of more than 10 mm, and most preferably of more than 12 mm, to be maintained between the retaining element attached to one of these parts or hinge flaps and the other part or hinge flap when the two hinged-together parts, i.e., the hinge flaps of the connecting element, are pivoted around an angle of approximately 60°.

As can be derived from the preceding explanation of inventive connecting devices, an inventive sectional door leaf comprises a plurality of panels arranged in sequence, which are connected to each other by the connecting elements of the inventive connecting devices, where the connecting device can be attached to one of the panels of the sectional door leaf by at least one fastening element, especially by a screw passing through the minimum of one third opening, and where this fastening element passes through a reinforced edge of the panel, especially a flanged edge.

In the inventive process for installing a sectional door with a door leaf comprising a plurality of hinged-together panels with the use of an inventive connecting device, the panels of the door leaf are first arranged in sequence one above the other and then hinged together by means of the connecting elements of the connecting device. Only after the guide rail arrangement has been attached with the use of the door leaf as an installation aid are the carrier elements, on which the guide elements are mounted, attached to the connecting elements.

BRIEF DESCRIPTION OF THE DRAWING

The invention is explained in greater detail below on the basis of the drawing, to which reference is expressly made with respect to all of the details which are essential to the invention but which have not been specifically discussed in the preceding description.

DETAILED DESCRIPTION OF THE INVENTION

Figure 1:
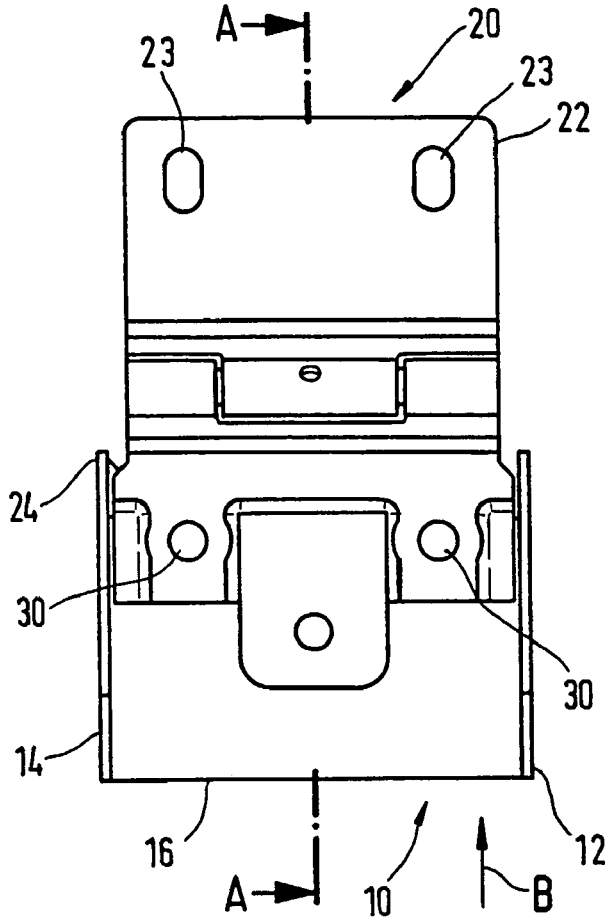
FIG. 1 shows a top view of an inventive connecting device.

The connecting device shown in the drawing consists essentially of a carrier element 10 and a connecting element 20, designed as a hinge. The connecting element 20 comprises two hinge flaps 22, 24, which are connected pivotably to each other by a hinge pin 26, which is held in the rolled parts formed at the ends of these hinge flaps 22, 24. The hinge flap 24 of the connecting element 20 shown at the bottom in the drawing comprises a contact surface 24*a*, which can be laid against the inner surface of a panel of a sectional door leaf, and a fastening surface 24*b*, which is a certain distance away from the contact surface 24*a* in a direction perpendicular to that surface. The contact surface 24*a* and the fastening surface 24*b* are arranged in such a way that a fastening area 16 of the carrier element 10 can be pushed into the intermediate space formed between the fastening surface 24*b* and the panel resting against the contact surface 24*a*, as can be seen very clearly in FIG. 2.

Figure 2:
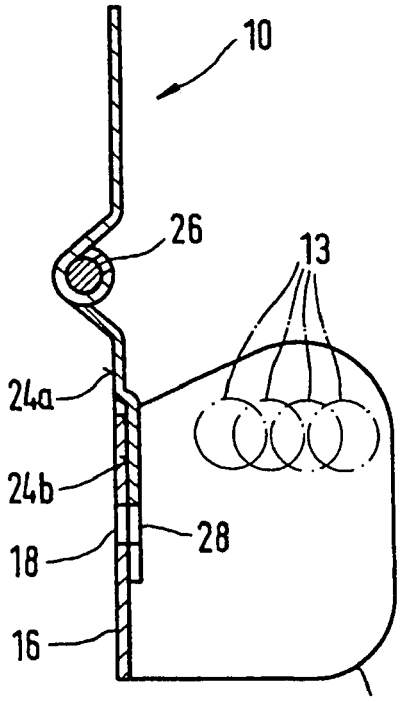
FIG. 2 shows a cross-sectional view of the connecting device shown in FIG. 1 along the cross-sectional line A-A indicated in FIG. 1.

The fastening surface 24*b* of the hinge flap 24 also has an opening 28 in it, as does the fastening area 18 of the carrier element 10. These openings 18 and 28 are arranged in such a way that, when the fastening area is inserted into the intermediate space shown between the fastening surface 24*b* and the panel (not shown), they can be brought into alignment with each other, as also illustrated in FIG. 2. After they have arrived in this position, a fastening screw can be passed through the openings 28 and 18 and introduced into the panel which is resting against the contact surface 24*a*. The carrier element 10 is thus attached very firmly to the connecting element 20. The hinge flap 24 has two additional openings 30, formed between the opening 28 and the joint axis formed by the hinge pin 26. These additional openings allow the hinge flap 24 to be attached to a panel of the sectional door leaf. The hinge flap 22 of the connecting element 20 also has two additional openings 23, each of which is designed as a slot. These openings allow the hinge flap 22 to be attached to the adjacent panel.

Figure 4:
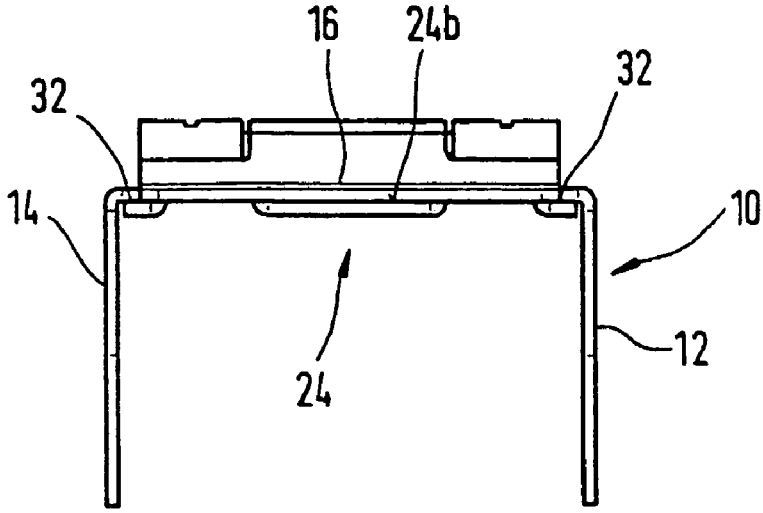
FIG. 4 shows an end view of the inventive connecting device from the perspective of the arrow B in FIG. 1.

As shown with particular clarity in FIG. 4, the carrier element 10 is designed with a U-shaped profile in a cross-sectional plane perpendicular to the contact surface 24*a* and parallel to the joint axis 26. The U-profile has two outer sidepieces 12, 14, and a connecting sidepiece 16, which connects the two outer sidepieces 12 and 14 to each other. The connecting sidepiece 16 serves as the fastening area. As shown especially clearly in FIG. 1, the connecting sidepiece 16 of the carrier element 10 does not extend over the entire length of the carrier element. Although it starts at the edge facing away from the joint axis 26, it proceeds only part of the way toward the joint axis 26. After the hinge flap 24 has been attached to the inner surface of a panel, therefore, the fastening area 18 can be pushed into the intermediate space formed between the fastening surface 24*b* and the inner surface of the panel without interference from the fastening screws passing through the openings 30.

As can be seen especially clearly in FIG. 4, the edges of the outer sidepieces 12 and 14 facing the connecting sidepiece 16 are flanged over toward the inside where the connecting sidepiece 16 does not extend, so that they can be pushed under additional fastening surfaces 32 provided on the hinge flap 24.

Figure 3:
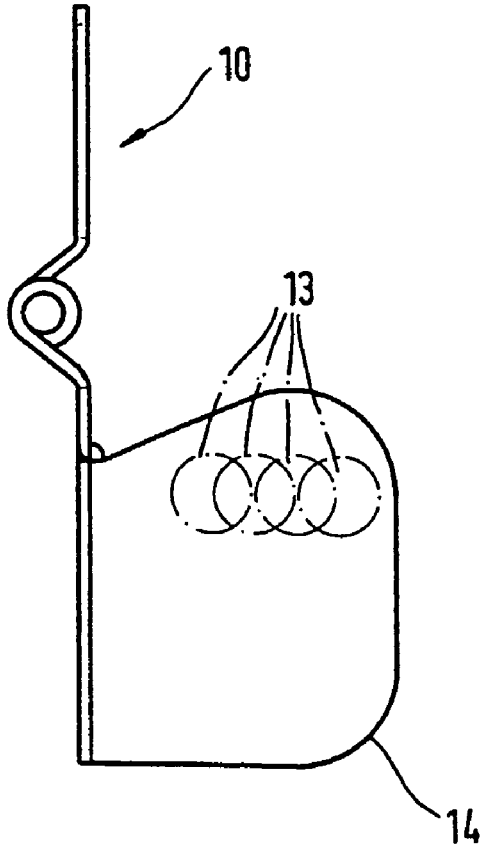
FIG. 3 shows a side view of the connecting device illustrated in FIG. 1.

As can be seen in FIGS. 2 and 3, each of the outer sidepieces 12 and 14 has an opening 13, which serves to accept the axle of a guide roller. Although the drawing shows four possible locations for this opening, only one of these locations will actually be used in one retaining element. The distance between the opening in the carrier element and the panel increases progressively from the lowermost panel of the door leaf to the uppermost panel of the door leaf. There is thus a continuous increase in the distance between the guide elements and the corresponding panels. As long as the guide rail arrangement has been installed properly, the door leaf will therefore be prevented, during the course of the opening and closing movements of the door leaf, from making sliding contact with the sealing strips located along the edges of the opening to be closed by the door leaf.

As can be seen clearly in FIGS. 2 and 3 in particular, the joint axis 26 is offset from the inner surface of the panel of the door leaf, i.e., the surface which can be laid against the contact surface 24*a*, toward the outside surface of the panel. This has the effect of reducing the danger of injury which might be caused by the projection of components of the connecting element into the interior space of the room to be closed by the sectional door leaf; in addition, the offset allows the panels attached to the hinge flaps 22, 24 to pivot in a way which prevents the formation of gaps, into which the fingers could be inserted and possibly pinched.

As can be derived from a comparative evaluation of FIGS. 1 and 2, the openings 13 in the outer sidepieces 12, 14 of the carrier element 10 lie in a plane which is perpendicular to the contact surface 24*a* and parallel to the joint axis 26 and passes through the openings 30. This means that the fastening elements for the hinge flaps 24 can also be located near the joint axis 26, as is the axle, which passes through the openings 13 and carries the roller, which cooperates with the guide rail arrangement (not shown in the drawing). The outer sidepieces 12, 14 of the carrier element 10 are shaped in such a way that, when the hinge flap 22 pivots with respect to the hinge flap 24 around an angle of 60°, a gap of more than 8 mm is maintained between them, in order in this way to avoid the danger that the fingers could get pinched in the area of the outer sidepieces of the carrier element.

The invention is not limited to the embodiment explained on the basis of the drawing. On the contrary, the connecting elements can also be used in situations where the joint parts attached to the successive panels are articulated together without the use of hinge pins. The carrier element can also be held in place exclusively by a clamping action between the fastening surface and the inner surface of the panel. In this case, the openings 18, 28 shown in the drawing can be eliminated. In addition, the shape of the outer sidepieces 12, 14 of the carrier element 10 can be different from that shown in the drawing.

The invention claimed is:

1. Connecting device for producing an articulated connection between successive panels of a sectional door leaf, the device comprising: a connecting element (20) that is attachable to two successive panels, the connecting element having a joint axis (26) about which the successive panels pivot; a carrier element (10); and a guide element mounted in the carrier element, the carrier element (10) being attachable to the connecting element (20), the connecting element (20) having at least one contact surface (24*a*) that is contactable with one of the two panels, and a fastening surface (24*b*) that is offset a certain distance away from the contact surface in a direction perpendicular to the contact surface so as to form an intermediate space between the fastening surface (24*b*) and the panel, the carrier element (10) having a fastening area (16) insertable into the intermediate space, the fastening surface (24*b*) having a first opening (28) and the fastening area (16) having a second opening (18), the first and second openings (18, 28) being aligned with each other when the fastening area (16) is inserted into the intermediate space, the carrier element (10) being formed as an essentially U-shaped profile made of the fastening area (16) in a plane parallel to the joint axis (26) and two outer sidepieces perpendicular to the contact surface (24*a*), each of the two outer sidepieces of the profile having an opening (13) arranged to accept a retaining bolt of the guide element so that the bolt is parallel to the joint axis (26), the fastening area (16) having the second opening (18).

2. Connecting device according to claim 1, wherein the contact surface (24*a*) has at least a third opening (30).

3. Connecting device according to claim 2, wherein the connecting element (20) has parts (22, 24), which are connected to each other so that they can pivot around the joint axis (26), and in that the third opening (30) is located between the first opening (28) and the joint axis (26).

4. Connecting device according to claim 1, wherein the opening (13) lies in a plane which is perpendicular to the contact surface (24*a*) and parallel to the joint axis (26) and passes through the third opening (30).

5. Connecting device according to claim 1, wherein, when the two parts (22, 24) pivot around an angle of approximately 60°, a gap of more than 8 mm is maintained between the carrier element (10) attached to one of the two parts (24) and the other of the two parts.

6. Sectional door leaf according to claim 5, wherein the gap is more than 10 mm.

7. Sectional door leaf according to claim 6, wherein the gap is more than 12 mm.

8. Sectional door leaf and an additional leaf, with a connecting device according to claim 1.

9. Sectional door leaf according to claim 8, wherein the connecting device is attached to one of the panels of the sectional door leaf by at least one fastening element which passes through the third opening.

10. Sectional door leaf according to claim 9, wherein the fastening element passes through a reinforced edge of the panel.

* * * * *